US005803290A

United States Patent [19]

Bongiorno

[11] Patent Number: 5,803,290

[45] Date of Patent: Sep. 8, 1998

[54] PLASTIC BLOW MOLDED BOTTLE HAVING ANNULAR GRIP

[75] Inventor: Joseph Bongiorno, Belleville, Mich.

[73] Assignee: Plastipak Packaging, Inc., Plymouth, Mich.

[21] Appl. No.: 696,011

[22] Filed: Aug. 12, 1996

[51] Int. Cl.[6] ..... B65D 1/02; B65D 23/10

[52] U.S. Cl. ..... 215/384; 215/383; 215/375; 220/675; 220/771

[58] Field of Search ..... 215/384, 385, 215/381; 220/675, 771

[56] References Cited

U.S. PATENT DOCUMENTS

| | | | |
|---|---|---|---|
| 3,182,861 | 5/1965 | Nataf | 215/384 X |
| 3,185,353 | 5/1965 | Mercier . | |
| 3,403,804 | 10/1968 | Colombo . | |
| 3,537,498 | 11/1970 | Amand . | |
| 3,934,743 | 1/1976 | McChesney et al. . | |
| 4,046,275 | 9/1977 | Virog, Jr. et al. . | |
| 4,082,200 | 4/1978 | Guest et al. . | |
| 4,274,548 | 6/1981 | Schneider . | |
| 4,406,854 | 9/1983 | Yoshino . | |
| 4,497,855 | 2/1985 | Agrawal et al. . | |
| 4,579,260 | 4/1986 | Young et al. . | |
| 4,733,804 | 3/1988 | Slat et al. . | |
| 4,805,808 | 2/1989 | Larson . | |
| 4,877,141 | 10/1989 | Hayashi et al. . | |
| 4,993,565 | 2/1991 | Ota et al. . | |
| 5,056,674 | 10/1991 | Swartley | 215/384 |
| 5,064,080 | 11/1991 | Young et al. . | |
| 5,139,162 | 8/1992 | Young et al. . | |
| 5,156,285 | 10/1992 | Zogg et al. | 215/384 |
| 5,158,190 | 10/1992 | Sosenko | 215/384 |
| 5,224,614 | 7/1993 | Bono et al. | 220/675 X |
| 5,287,978 | 2/1994 | Young et al. . | |
| 5,303,834 | 4/1994 | Krishnakumar et al. | 220/675 X |
| 5,337,909 | 8/1994 | Vailliencourt | 215/381 |
| 5,341,946 | 8/1994 | Vailliencourt et al. | 215/381 |
| 5,385,250 | 1/1995 | Pasquale | 220/771 X |
| 5,407,086 | 4/1995 | Ota et al. | 220/675 X |

FOREIGN PATENT DOCUMENTS

| | | |
|---|---|---|
| 0055595 | 7/1982 | European Pat. Off. . |
| 1333343 | 6/1963 | France . |
| 1353643 | 1/1964 | France . |
| 1383069 | 11/1964 | France . |
| 2025889 | 1/1980 | United Kingdom . |

*Primary Examiner*—Sue A. Weaver
*Attorney, Agent, or Firm*—Brooks & Kushman P.C.

[57] ABSTRACT

A biaxially oriented plastic blow molded bottle (10) has a domed upper dispensing end (12), a lower freestanding base (14) about whose central hub (24) legs (26) and ribs (28) alternate, and a round body portion (16) with an inwardly extending annular grip (32) constructed to facilitate manual grasping of the bottle. The body portion (16)has the same diameter D above and below the annular grip (32). The annular grip (32) includes upper and lower ends (34,36) that extend outwardly with curved shapes with the upper end having a more abrupt curvature than the lower end. An intermediate portion (38) of the annular grip extends between the upper and lower ends with an inwardly curved shape that is less abrupt than the upper end (34) but more abrupt than the lower end (38). In one embodiment, the bottle ($\mathbf{10}_{tag}$) has its annular grip ($\mathbf{32}_{tag}$) provided with a textured outer surface (33) that facilitates gripping of the bottle.

9 Claims, 3 Drawing Sheets

PLASTIC BLOW MOLDED BOTTLE HAVING ANNULAR GRIP

TECHNICAL FIELD

This invention relates to a plastic blow molded bottle having an annular grip that facilitates manual grasping of the bottle for dispensing of its contents.

BACKGROUND ART

Annular grips for bottles are disclosed by U.S. Pat. Nos. 3,185,353 Mercier, 3,537,498 Amand and 5,385,250 Pasquale as well as by British Patent document GB 2025889 A and by European patent application Publication No. 0 055 595. Other grips and horizontally extending ribs for containers are disclosed by U.S. Pat. Nos.: 3,403,804 Colombo; 3,934,743 McChesney et al; 4,046,275 Virog, Jr. et al; 4,082,200 Guest et al; 4,274,548 Schneider; 4,006,854 Yoshino; 4,497,855Agrawal et al; 4,579,260 Young et al; 4,733,804 Slat et al; 4,877,141 Hayashi et al; 4,805,808 Larson; and 4,933,565 Ota et al as well as by French Patent Publication Nos.: 1,333,343; 1,353,643; and 1,383,069.

Plastic blow molded bottles are conventionally made by providing a hot plastic parison either from extruded plastic or as a preform which is usually injection molded from plastic. Such preforms are advantageously axially stretched upon the blow molding to provide biaxial orientation that strengthens the resultant bottle. Previously, such bottles had hemispherical lower ends which were mounted within base cups to support of the bottles in an upstanding position on a horizontal support surface. More recently, such plastic blow molded bottles have been manufactured with freestanding base structures such as disclosed by U.S. Pat. Nos. 5,064,088 Young et al, 5,139,162 Young et al and 5,287,978 Young et al.

DISCLOSURE OF INVENTION

An object of the present invention is to provide a biaxially oriented plastic blow molded bottle whose construction facilitates gripping thereof for dispensing of the bottle contents.

In carrying out the above object, a biaxially oriented plastic blow molded bottle constructed in accordance with the present invention includes an upper dispensing end having an upper dome and a dispensing spout that extends upwardly from the upper dome and has a closure retainer. A lower freestanding base of the bottle includes a central hub as well as hollow legs and curved ribs positioned around the hub in an alternating relationship such that the legs support the bottle in an upright position on a suitable horizontal support surface. A round body portion of the bottle extends vertically between the upper dispensing end and the lower freestanding base. This round body portion has a generally cylindrical shape with a diameter D and also has an annular grip that extends inwardly from the cylindrical shape with a minimum diameter $D_g$ that is less than 0.85 of the diameter D. The body portion has the same diameter D above and below the annular grip. The annular grip includes upper and lower ends having outwardly curved shapes with the upper end thereof having a more abrupt curvature than its lower end. The annular grip also has an intermediate portion that extends between the upper and lower ends thereof with an inwardly curved shape that defines the minimum $D_g$ above the midpoint of the height of the body portion between the upper dispensing end and the lower freestanding base.

The more abrupt curvature of the upper end of the annular grip as compared to the lower end thereof facilitates manual grasping upon upward manual movement to pick the bottle upwardly off a horizontal support surface in addition to providing rigidity of the bottle when so held for dispensing of the bottle contents.

In the preferred construction of the bottle, the upper dome of the dispensing spout extends upwardly with a radius of curvature which is no greater than 0.5 of the diameter D of the round body portion.

In the preferred construction of the bottle, the intermediate portion of the annular grip has a less abrupt curvature than the upper end thereof and has a more abrupt curvature than its lower end. More specifically, the upper end of the annular grip preferably has a radius of curvature $R_u$, the intermediate portion of the annular grip has a radius of curvature $R_i$ that is about 2.0 times the radius of curvature $R_u$ of its upper end, and the lower end of the annular grip has a radius of curvature $R_1$ that is about 4.0 times the radius of curvature $R_u$ of its upper end. Furthermore, the radius of curvature $R_u$ of the upper end of the annular grip is preferably less than 0.15 of the diameter D of the body portion.

The preferred construction of the bottle has each hollow leg of the freestanding base provided with an outer wall of a radius of curvature $R_w$ that is greater than 0.75 of the diameter D of the body portion such that the diameter D of the body portion is less than 1⅓ times the radius of curvature $R_w$ of the outer wall of each foot. Furthermore, each curved rib preferably has a radius of curvature $R_r$ that is greater than 0.6 of the diameter D of the body portion such that the diameter D of the body portion is less than 1⅔ times the radius of curvature $R_r$ of each curved rib.

In one preferred embodiment of the bottle, the annular grip has an outer textured surface to facilitate gripping of the bottle.

Best results are achieved when the annular grip that extends inwardly from the cylindrical shape of the body portion has a minimum diameter $D_g$ that is about 0.7 of the diameter D of the cylindrical shape of the body portion and with the annular grip having an overall height of about ⅝ of the diameter D of the body portion.

The objects, features and advantages of the present invention are readily apparent from the following detailed description of the best mode for carrying out the invention when taken in connection with the accompanying drawings.

BEST MODE FOR CARRYING OUT THE INVENTION

Figure 1:
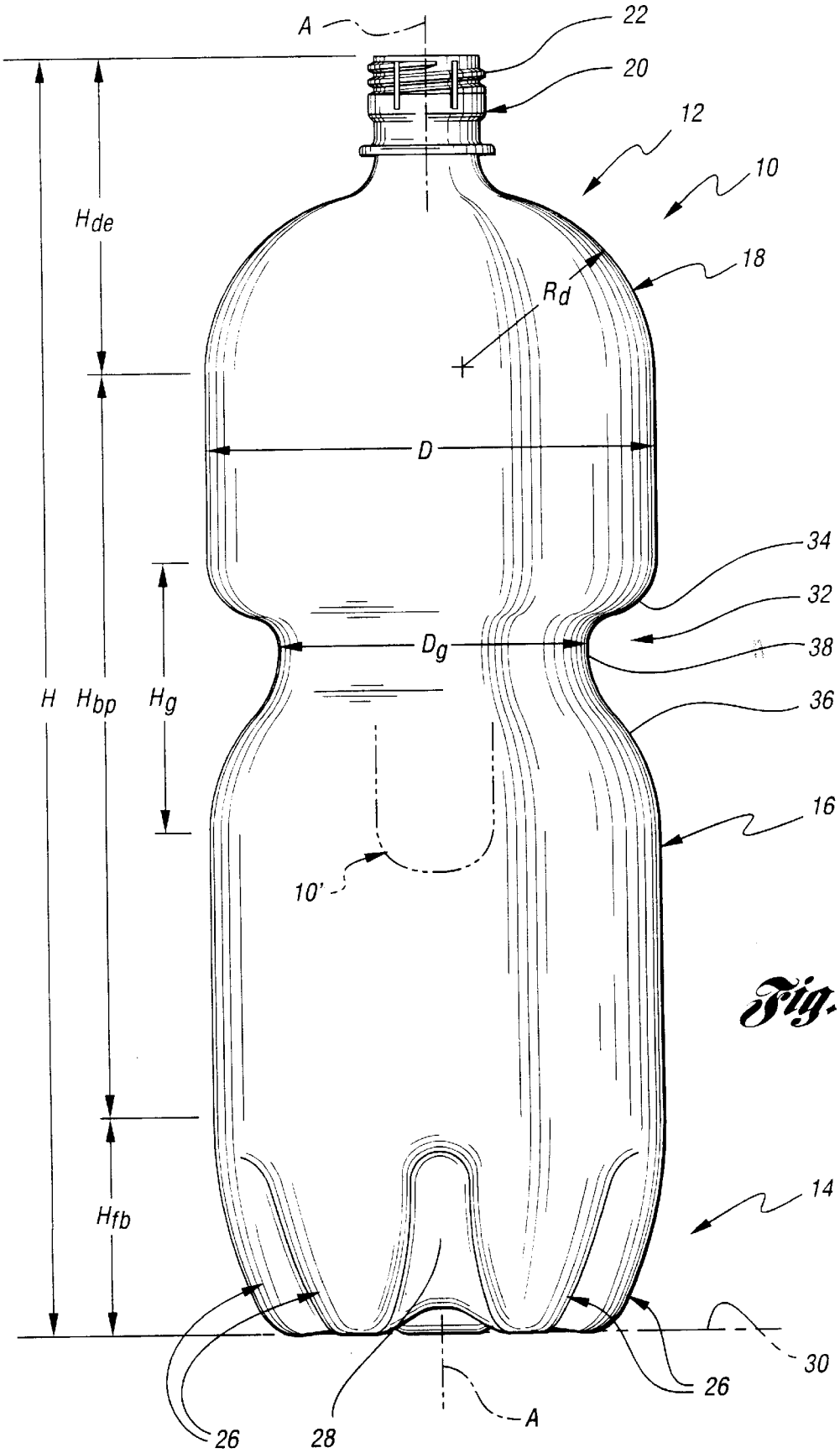
FIG. 1 is an elevational view of a biaxially oriented plastic blow molded bottle constructed in accordance with the present invention.

With reference to FIG. 1 of the drawings, a plastic blow molded bottle is generally indicated by 10 and is preferably made of polyethylene terephthalate with a construction for holding carbonated beverages as is hereinafter more fully described. The bottle 10 is blow molded from a preform 10' that has a shorter height than the overall height H of the bottle such that axial stretching during the blow molding process provides the biaxial orientation that strengthens the bottle so as to be better capable of withstanding internal pressure. As is hereinafter more fully described, the bottle 10 includes an upper dispensing end 12 having a height $H_{de}$, a lower freestanding base 14 having a height $H_{fb}$ and a round body portion 16 that extends vertically between the upper dispensing end and the lower freestanding base with a height $H_{bp}$ and with a diameter D about a central axis A of the bottle.

With continuing reference to FIG. 1, the upper dispensing end 12 of the bottle includes an upper dome 18 and a dispensing spout 20 having an opening through which the bottle is filled and through which the bottle contents are dispensed. The spout 20 has a closure retainer 22 for securing an unshown closure cap.

Figure 3:
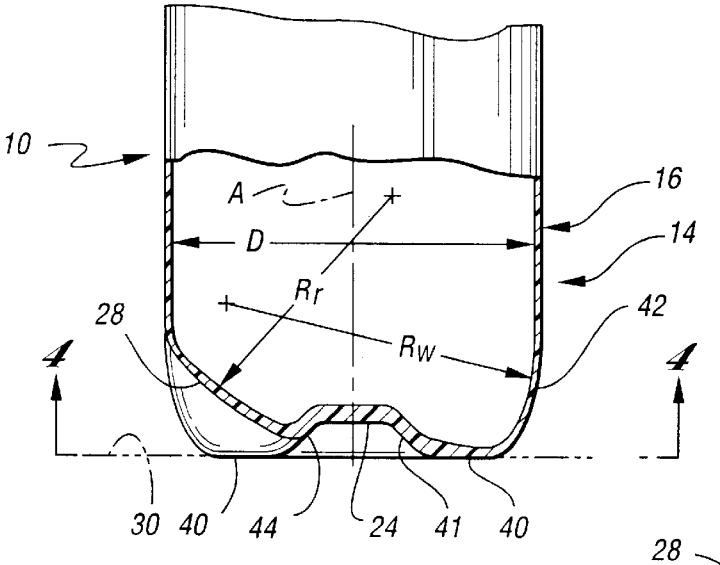
FIG. 3 is a partial view taken in section to illustrate the construction of a freestanding base of the bottle.
Figure 4:
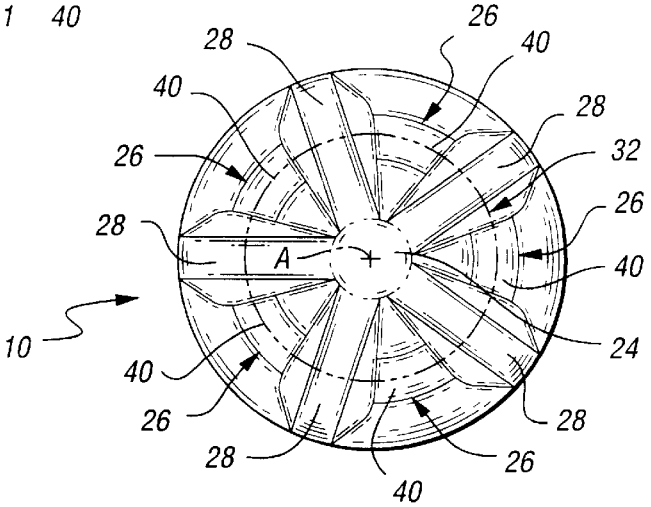
FIG.4 is a bottom plan view taken along the direction of line 4—4 in FIG. 3 to further illustrate the construction of the freestanding base.

As shown in FIGS. 1, 3 and 4, the lower freestanding base 14 of the bottle 10 includes a central hub 24 (FIGS. 3 and 4) as well as hollow legs 26 and curved ribs 28 positioned around the hub in an alternating relationship such that the legs support the bottle in an upright position on a horizontal support surface 30.

Figure 2:
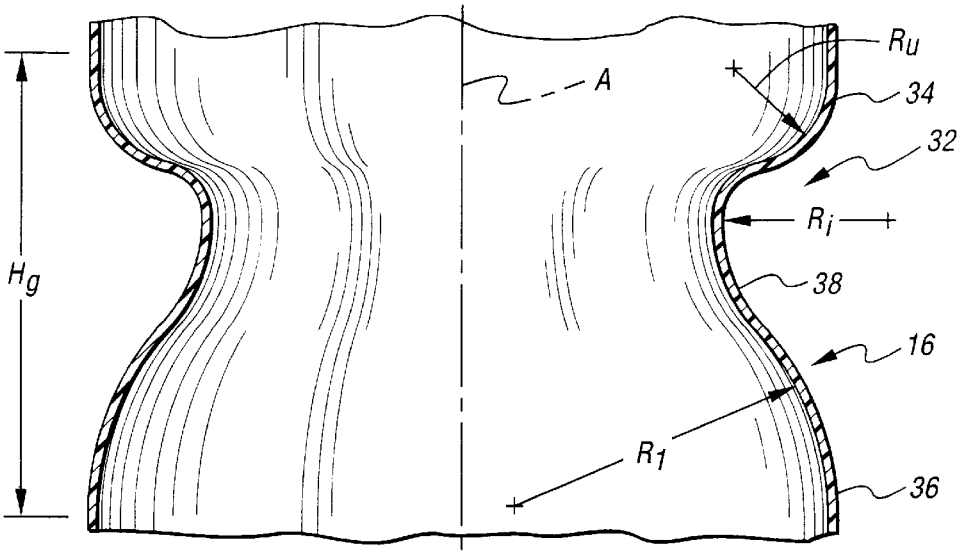
FIGURE 2 is a partial view taken in section of an annular grip of the bottle.

As shown in FIG. 1, the round body portion of bottle 10 between the upper dispensing end 12 and the lower freestanding base 14 includes a generally cylindrical shape having the body portion diameter D previously mentioned. This body portion 16 also has an annular grip 32 that extends inwardly from its cylindrical shape with a minimum diameter $D_g$ that is less than 0.85 of the diameter D. The cylindrical body portion 16 thus has the same diameter D above and below the annular grip 32. This annular grip 32 has an uninterrupted construction extending about the central axis A and as also shown in FIG. 2 includes upper and lower ends 34 and 36 having outwardly curved shapes with the upper end having a more abrupt curvature than the lower end. The annular grip 32 also has an intermediate portion 38 that extends between the upper and lower ends thereof with a inwardly curved shape that defines the minimum diameter $D_g$ above the midpoint of the height $H_{bp}$ (FIG. 1) of the body portion 16 between the upper dispensing end 12 and the lower freestanding base 14.

The construction of the annular grip 32 facilitates manual gripping of the bottle 10 when lifted upwardly from the horizontal support surface 30 as shown in FIG. 1. Specifically, the more abrupt curvature of the upper end 34 of the annular grip 32 and the less abrupt curvature of the lower end 36 facilitates upward and inward manual movement for grasping of the bottle. Furthermore, the smaller diameter $D_g$ provides increased rigidity to the bottle when manually held such as for dispensing of the bottle contents.

With continuing reference to FIG. 1, the bottle 10 has its upper dome 18 preferably provided with a radius of curvature $R_d$ that is no greater than 0.5 of the diameter D of the round body portion and most preferably just slightly greater than 0.4 of the diameter D. This construction provides increased fill capacity for a bottle having a conventional height H and maximum diameter D for the volume of contents to be held in order to compensate for the lost volume resulting from the inwardly extending annular grip 32. As such, conventional filling and capping equipment can be utilized so that there is no unusual expense in connection with the bottle.

In its preferred construction, the intermediate portion 38 of the annular grip 32 has a less abrupt curvature than the upper end 34 thereof and has a more abrupt curvature than its lower end 36. More specifically, the upper end 34 of the annular grip 32 has a radius of curvature $R_u$ while the intermediate portion 38 of the annular grip has a radius of curvature $R_i$ that is about 2.0 times the radius of curvature $R_u$ of the upper end. Furthermore, the lower end of the annular grip has a radius of curvature $R_1$ that is about 4.0 times the radius of curvature $R_u$ of its upper end. More specifically, the radius of curvature $R_u$ of the upper end of the annular grip is less than 0.15 of the diameter D of the body portion and most preferably about 0.12 of the body portion diameter D.

As illustrated by combined reference to FIGS. 1, 3 and 4, the preferred construction of the lower freestanding base 14 has each hollow leg 26 provided with a lower flat foot 40 that is supported on the associated horizontal support surface 30. Each hollow leg 26 also has an inclined connection portion 41 that extends upwardly from the foot 40 to the hub 24 and also has an outer wall 42 that extends upwardly from the outer end of the foot 40 to the body portion 16 with a curved shape. This curved shape of the outer wall 42 has a radius of curvature $R_w$ that is greater than 0.75 of the diameter D of the bottle body portion 16, such that the diameter D of the body portion is less than 1⅓ times the radius of curvature $R_w$ of the outer wall. Furthermore, each curved rib 28 extends from the bottle body portion 16 downwardly to a connecting portion 44 to the hub 24 and has a radius of curvature $R_r$ that is greater than 0.6 of the diameter D of the bottle body portion with a center of curvature on the opposite side of the central axis A from the associated curved rib. The diameter D of the body portion 16 is thus less than 1⅔ times the radius of curvature $R_r$ of each curved rib 28. Also, it should be noted that it is possible for the curved ribs 28 to taper in width in an outward direction so that there is a greater width at the hub 24 for connection thereto where the bottle has thicker unoriented material. In this regard, it should be noted that the thicker unoriented material is located at the hub 24 and extends outwardly through the connecting portion 42 and the flat foot 40 of each leg 42 as well as extending outwardly through most of the radial extent of each curved rib 28. This thicker unoriented material is thus configured to withstand the internal pressure of carbonated beverages while the thinner outer wall 42 of each leg and the thinner outer extent of each curved rib 28 as well as the thinner body portion 16 and the thinner upper dome 18 are biaxially oriented to withstand the internal pressure.

In the most preferred construction of the bottle 10, the annular grip 32 extends inwardly from the cylindrical shape of the body portion 16 and defines a minimum diameter Dg that is about 0.7 of the diameter D of the body portion. Furthermore, the annular grip 32 has an overall height $H_g$ of about ⅝ of the diameter D of the body portion. In addition, the upper dispensing end 12 has its height $H_{de}$ preferably about 0.25 of the overall height H of the bottle, while the freestanding base 14 has its height $H_{fb}$ provided as about 0.17 of the overall height H of the bottle and the body portion 16 has its height $H_{bp}$ provided as about 0.58 of the overall height H of the bottle.

Figure 5:
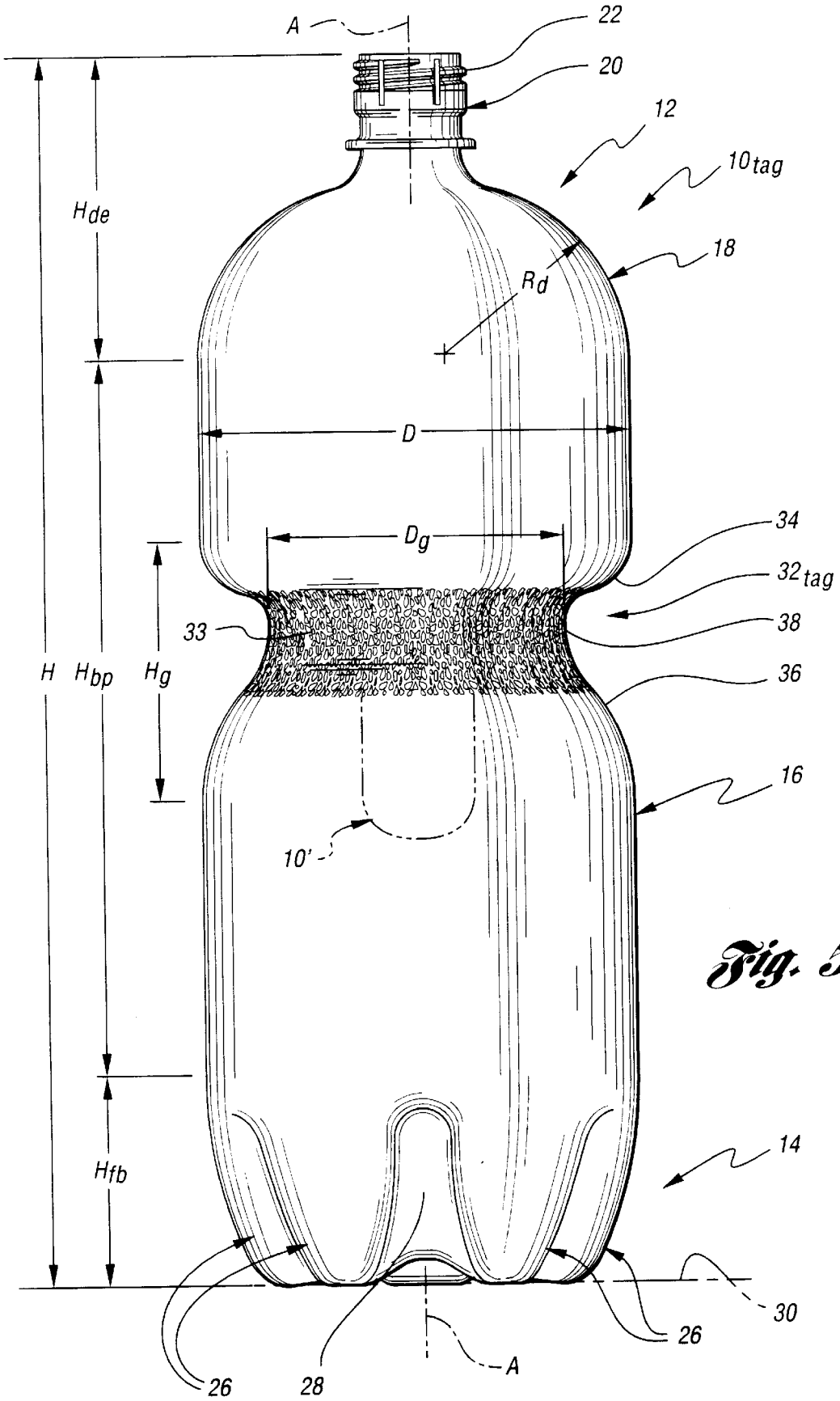
FIG. 5 is an elevational view similar to FIG. 1 of another embodiment wherein an annular grip thereof has an outer textured surface for facilitating gripping of the bottle.

With reference to FIG. 5, another preferred embodiment of the bottle is indicated by reference numeral $\mathbf{10}_{tag}$ and has the same construction as the bottle of FIGS. 1 through 4 except as will be noted such that like reference numerals are utilized to indicate like portions thereof and most of the previous description is thus applicable and will not be repeated. The bottle $\mathbf{10}_{tag}$ has its annular grip $\mathbf{32}_{tag}$ provided with an outer textured surface 33 that facilitates manual gripping of the bottle during use. This textured surface 33 of the annular grip $32_{tag}$ tag extends from approximately the lower extremity of the upper end 34 thereof to approximately the upper extremity of the lower end 36 thereof and is thus largely located on the intermediate portion 38 thereof that extends between the upper and lower ends. Any suitable type of texturing for increasing the gripability of the annular grip $32_{tag}$ can be utilized.

While the best mode for carrying out the invention has been described in detail, those familiar with the art to which this invention relates will recognize various alternative designs and embodiments for practicing the invention as defined by the following claims.

What is claimed is:

1. A biaxially oriented plastic blow molded bottle comprising:

an upper dispensing end including an upper dome and a dispensing spout that extends upwardly from the upper dome and has a closure retainer;

a lower freestanding base including a central hub as well as hollow legs and curved ribs positioned around the hub in an alternating relationship such that the legs support the bottle in an upright position on a suitable horizontal support surface; and a round body portion that extends vertically between the upper dispensing end and the lower freestanding base, said round body portion having a generally cylindrical shape with a diameter D and also having an annular grip that extends inwardly from the cylindrical shape with a minimum diameter $D_g$ that is less than 0.85 of the diameter D, the body portion having the same diameter D above and below the annular grip, the annular grip including upper and lower ends having outwardly curved shapes with the upper end thereof having a more abrupt curvature than the lower end thereof, and the annular grip also having an intermediate portion that extends between the upper and lower ends thereof with an inwardly curved shape that defines the minimum diameter $D_g$ above the midpoint of the height of the body portion between the upper dispensing end and the lower freestanding base.

2. A biaxially oriented plastic blow molded bottle as in claim 1 wherein the upper dome of the dispensing spout extends upwardly with a radius of curvature $R_d$ that is no greater than 0.5 of the diameter D of the round body portion.

3. A biaxially oriented plastic blow molded bottle as in claim 1 wherein the intermediate portion of the annular grip has a less abrupt curvature than the upper end thereof and has a more abrupt curvature than its lower end.

4. A biaxially oriented plastic blow molded bottle as in claim 3 wherein the upper end of the annular grip has a radius of curvature $R_u$, the intermediate portion of the annular grip having a curvature $R_i$ that is about 2.0 times the radius of curvature $R_u$ of its upper end, and the lower end of the annular grip having a radius of curvature $R_l$, that is about 4.0 times the radius of curvature $R_u$ of its upper end.

5. A biaxially oriented plastic blow molded bottle as in claim 4 wherein the radius of curvature $R_u$ of the upper end of the annular grip is less than 0.15 of the diameter D of the body portion.

6. A biaxially oriented plastic blow molded bottle as in claim 1 wherein each hollow leg of the freestanding base has an outer wall with a radius of curvature $R_w$ that is greater than 0.75 of the diameter D of the body portion, and each curved rib having a radius of curvature $R_r$ that is greater than 0.6 of the diameter D of the body portion.

7. A biaxially oriented plastic blow molded bottle as in claim 1 wherein the annular grip has an outer textured surface to facilitate gripping of the bottle.

8. A biaxially oriented plastic blow molded bottle comprising:

an upper dispensing end including an upper dome and a dispensing spout that extends upwardly from the upper dome and has a closure retainer, and the upper dome extending upwardly with a radius of curvature $R_d$;

a lower freestanding base including a central hub as well as hollow legs and curved ribs positioned around the hub in an alternating relationship such that the legs support the bottle in an upright position on a suitable horizontal support surface, each hollow leg of the freestanding base having an outer wall with a radius of curvature $R_w$, and each curved rib having a radius of curvature $R_r$; and a round body portion that extends vertically between the upper dispensing end and the lower freestanding base, said round body portion having a generally cylindrical shape with a diameter D that is no less than 2.0 times the radius of curvature $R_d$ of the upper dome of the upper dispensing end as well as being less than 1⅓ times the radius of curvature $R_w$ of the outer wall of each foot and less than 1⅔ times the radius of curvature $R_r$ of each curved rib, the round body portion having an annular grip that extends inwardly from the cylindrical shape with a minimum diameter Dg that is less than 0.85 of the diameter D, the body portion having the same diameter D above and below the annular grip, the annular grip including upper and lower ends having outwardly curved shapes with the upper end thereof having a more abrupt curvature than the lower end thereof, and the annular grip also having an intermediate portion that extends between the upper and lower ends thereof with an inwardly curved shape that defines the minimum diameter $D_g$ above the midpoint of the height of the body portion between the upper dispensing end and the lower freestanding base.

9. A biaxially oriented plastic blow molded bottle comprising:

an upper dispensing end including an upper dome and a dispensing spout that extends upwardly from the upper dome and has a closure retainer, and the upper dome extending upwardly with a radius of curvature $R_d$;

a lower freestanding base including a central hub as well as hollow legs and curved ribs positioned around the hub in an alternating relationship such that the legs support the bottle in an upright position on a suitable horizontal support surface, each hollow leg of the freestanding base having an outer wall with a radius of curvature $R_w$, and each curved rib having a radius of curvature $R_r$; and a round body portion that extends vertically between the upper dispensing end and the lower freestanding base, said round body portion having a generally cylindrical shape with a diameter D that is no less than 2.0 times the radius of curvature $R_d$ of the upper dome of the upper dispensing end as well as being less than 1⅓ times the radius of curvature $R_w$ of the outer wall of each foot and less than 1⅔ times the radius of curvature $R_r$ of each curved rib, the round body portion having an annular grip that extends inwardly from the cylindrical shape with a minimum diameter $D_g$ that is about 0.7 of the diameter D, the body portion having the same diameter D above and below the annular grip, the annular grip having an outer textured surface that facilitates gripping thereof and having an overall height of about ⅝ of the diameter D of the body portion, the annular grip including upper and lower ends having outwardly curved shapes, the annular grip also having an intermediate portion that extends between the upper and lower ends thereof with an inwardly curved shape that defines the minimum diameter $D_G$ above the midpoint of the overall height of the bottle, the upper end of the annular grip having a radius of curvature $R_u$ that is less than 0.15 of the diameter D of the body portion, the intermediate portion of the annular grip having a curvature $R_i$ that is about 2.0 times the radius of curvature $R_u$, of its upper end, and the lower end of the annular grip having a radius of curvature $R_l$ that is about 4.0 times the radius of curvature $R_u$of its upper end.

* * * * *